United States Patent [19]

Rainbow

[11] 4,126,129

[45] Nov. 21, 1978

[54] METHOD AND APPARATUS FOR RELIEVING BACKACHES AND PAINS WITHOUT THE USE OF DRUGS

[76] Inventor: John R. Rainbow, 41 E. 7th St., New York, N.Y. 10003

[21] Appl. No.: 885,365

[22] Filed: Mar. 13, 1978

Related U.S. Application Data

[63] Continuation of Ser. No. 767,739, Mar. 2, 1977, abandoned.

[51] Int. Cl.[2] ..... A61H 7/00; A61H 5/00

[52] U.S. Cl. ..... 128/67; 128/69

[58] Field of Search ..... 128/67, 60, 24.1, 69, 128/62 R, 57, 25 B, 135, 115

[56] References Cited

U.S. PATENT DOCUMENTS

| | | | |
|---|---|---|---|
| 1,375,314 | 4/1921 | Overton | 128/69 |
| 1,398,150 | 11/1921 | Pollard | 128/69 |
| 1,668,489 | 5/1928 | Brand | 128/69 |
| 2,168,975 | 8/1939 | Clarke | 128/62 R |
| 2,466,470 | 4/1949 | Norris | 128/57 X |
| 2,521,530 | 9/1950 | McGuffage | 128/69 UX |
| 2,777,440 | 1/1957 | Baker | 128/69 |
| 3,858,579 | 1/1975 | Ching | 128/57 |
| 3,901,222 | 8/1975 | Muramatsu | 128/69 |

FOREIGN PATENT DOCUMENTS

| | | | |
|---|---|---|---|
| 122,883 | 2/1919 | United Kingdom | 128/69 |
| 1,261,540 | 1/1972 | United Kingdom | 128/69 |

*Primary Examiner*—Lawrence W. Trapp
*Attorney, Agent, or Firm*—John K. Conant

[57] ABSTRACT

A generally hemispheric shaped dome, which has a flat nonskid base, is on the order of 1½ inches (3.8 cm.) high from base to apex and is made of a hard nonresilient material. It is placed on a substantially rigid support surface which at least coincides in area with the major portion of a person's back from buttocks to shoulder. A person having an area of pain in his or her back presses his or her back against the dome with the apex of the dome at or adjacent to the area of greatest pain, but not against the spinal column.

10 Claims, 4 Drawing Figures

METHOD AND APPARATUS FOR RELIEVING BACKACHES AND PAINS WITHOUT THE USE OF DRUGS

BRIEF SUMMARY OF THE INVENTION

This is a continuation of prior abandoned application Ser. No. 767,739, filed Mar. 2, 1977, now abandoned.

The present invention relates to a method and apparatus for greatly relieving a person's backaches and pains without the use of drugs. This method utilizing the apparatus disclosed relieves sprains and strains of back muscles and ligaments, can be applied to produce corrective postural adjustments for relieving pain, and manages many forms of musculo-skeletal pain in all regions of the spine.

This method utilizes a generally hemispheric dome of a hard, nonresilient material, such as glass or a hard acrylic plastic. The dome has a flat base with a nonskid surface thereon adapted to be placed on a substantially flat rigid support surface which coincides in area with at least the major portion of the back, from the buttocks to the shoulders, of the person applying the method. The nonskid surface of the base of the dome is to resist lateral displacement of the dome on the support surface in the practice of the method.

The height of the dome from base to apex is suitably on the order of 1½ inches (3.81 cm.) and should be within the range of from about 1½ to 2¼ inches (3.81 to 5.71 cms.). Its diameter at the base is suitably about twice the height; however, the height of the dome is critical to the effectiveness of the method while it's diameter is not.

The person applying the method places the dome on the support surface and presses his or her back against the dome. The support surface may be in horizontal, slanted or vertical position. The support surface is placed to be aligned with the major portion of the person's back and the dome is positioned on the support surface so that the apex of the dome is at or adjacent to the location of the greatest concentration of pain, but it should not be placed directly against the person's spinal column.

The person either actively presses against the dome or lets the weight of his or her body press the dome into the paining area, depending upon the amount of pain and the person's sensitivity to it. In practice it has been found that this pressure of the hard domed surface into the back in the area of the pain relieves the pain amazingly, and the relief lasts for hours after a period of this pressure treatment. A treatment may take just a few minutes or may require an hour or so until relief is obtaind, depending upon the particular condition causing the pain and its severity.

The dome may be moved to press against successively different portions of the paining area in order to maximize the relief. It will be understood however that the therapeutic effect results from the direct pressure concentrated at a point continuously for at least a few minutes and does not depend upon contact movement of the dome as in conventional massage.

PRIOR ART STATEMENT

The closest prior art of which applicant is aware is illustrated by U.S. Pat. No. 2,777,440 to P. G. Baker and U.S. Pat. No. 2,521,520 to L. B. McGuffage.

The Baker patent discloses a muscle relaxer consisting of a pair of semi-hard rubber balls held in adjustable spaced relation on a board by means of a cover extending over the balls and secured to the edges of the board. The person using the device lies on the balls which are placed under the small of his or her back, the lateral spacing of the balls being adjusted to the width of the person so as to bear against the small of the back, respectively at opposite sides of the spine. The pressure applied by the balls may be increased by raising the board, and the balls thereon, by folding a supplemental board in under the board on which the balls are mounted. No range of heights is mentioned for the balls to achieve the most effectiveness, and the balls are only semi-hard. In contradistinction applicant has found that the greatest effect for relieving back pain is a single hard domed projection stabilized in position, by its flat nonskid base, to bear against a selected portion of the area of pain. Moreover, applicant's apparatus and method is effective for any area of the back, not just the small of the back.

The McGuffage patent discloses an inflatable pillow with a sponge rubber covering for raising and supporting a particular portion of a patient's body up from the surface of a table on which the patient is lying. Whereas the McGuffage pillow is a passive support to position a patient for the application of manipulative treatment, such as massage, applicant's dome is itself an active treating device, the treatment consisting of the patient's body pressing against the dome. Also applicant's dome depends in part for it's effectiveness on its being hard and substanially non-resilient, whereas McGuffage's pillow, even if inflated to substantial rigidity, is nonetheless to some extent resilient due to the inherent resiliency of an inflated pillow and additionally to the sponge rubber covering on the McGuffage pillow.

BRIEF DESCRIPTION OF THE VIEWS OF THE DRAWING

The invention is described below in more detail with reference to the accompanying drawing in which.

DETAILED DESCRIPTION OF THE INVENTION

Qdfdqhmg to FIF. 0 the key ekemdmt of the imudmsion is a dome 10 of hard nonresilient material, such as glass or a hard acrylic plastic. The dome 10 is generally hemispheric in shape, having an apex 11 and a flat base 12 which is provided with a nonskid surface.

Figure 2:
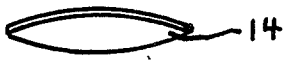
FIG. 2 is a perspective view of a pad of resilient nonskid material that may be attached on the dome base to provide the nonskid surface thereon.

In a preferred form the nonskid surface of the base 12 is provided by attaching thereon a pad 14, FIG. 2, of resilient material, such as foam rubber, which has a nonskid surface.

For maximum effectiveness of the method the overall height of the dome 10, from the undersurface of the base 12 to the apex 11, is between about 1½ to 2¼ inches (3.81 to 5.71 cwhich has a nonskid surface.

For maximum effectiveness of the method the overall height of the dome 10, from the undersurface of the base 12 to the apex 11, is between about 1½ to 2¼ inches (3.81 to 5.71 cms.). Within this range the hard portion of the dome, i.e. the dome without a pad 14, is from about 1¼ to 1½ inches (3.17 to 3.81 cms.) in height and the pad 14 may be any thickness up to about ¾ of an inch (1.90 cm.) thick. In any event the hard portion of the dome 10 should be the major portion of the height of the dome and pad combination so as not to change the essentially hard characteristic of the dome 10 as a source of point pressure in the practice of the method.

Figure 3:
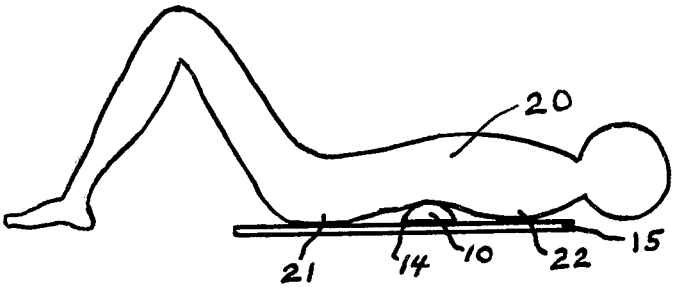
FIG. 3 is a side view showing the manner in which a person utilizes the dome on a flat support surface to obtain relief of back pain in accordance with the invention.

As illustrated in FIG. 3, in the practice of the method the dome 10 is placed on a substantially flat rigid support surface 15 to be captured between the support surface 15 and the back of a person 20 who aligns the support surface with his or her back and presses his or her back against the dome. Pressure of the person's back against the dome 10 may be created by the weight of the person or by the person actively pressing against the dome.

The beneficial effects of the pressure of the dome 10 may be enhanced by the person 20 doing a variety of exercises which increase and vary the pressure against the dome. For example, the pressure may be increased by the person raising one or both legs to a vertical position from horizontal and the pressure may be increased and beneficially varied by the person 'bicycling' his or her legs.

In practice, as described above, the dome 10 is positioned for it's apex 11 to press against the back of the person 20 in the area of the back at which the pain is concentrated. It should not, however, be placed against the person's spinal column.

For proper support and for positioning the dome 10 in a variety of positions in relation to the back of the person 20, the area of the support surface 15 is at least as large as, and shaped to coincide with, the area of the person's back from the buttocks 21 to the shoulders 22.

The support surface 15 may be placed to be horizontal, vertical or slanted. For example, the support surface may be a floor, a wall, a flat chair back, or a specially provided board or rigid sheet of material that can be placed on a bed, or against the back of a chair or seat, including the seat of an automobile.

To assure most effective practice of the method the support surface 15 is preferably a rigid board, such as a rigid acrylic sheet, of dimensions at least coinciding with the area of a lerge person's back from buttocks to shoulder and having a chart of pressure points marked thereon. The chart indicates strategic points in the cervical, shoulder, dorsal, lumbar and sacroiliac regions of a person's back at which the dome 10 is best positioned to apply pressure for relieving pain in the particular region.

The dome 10 may usefully be moved to successively different positions, to be applied to different portions of the paining area. It is adapted to be maintained in a desired position for a useful amount of time by the nonskid surface on the dome base 12 which resists lateral slippage or skidding on the support surface 15.

The principal function of the pad 14 on the base 12 of the dome is to provide a nonskid surface on the base. However, it has been found that the maximum and minimum pressures capable of being applied by a person 20 pressing his or her back against the dome 10 may be adjusted slightly by substituting a resilient pad 14 of a different thickness. The thinest pad provides for the greatest possible pressure; thicker resilient pads reduce the amount of pressure applicable.

The pad 14 is removably attached on the dome base 12 by any suitable means such as by a restickable adhesive on the mating surfaces of the base 12 and pad 14, or by Velcro detachable fastener material secured respectively on the base and pad mating surfaces.

Figure 4:
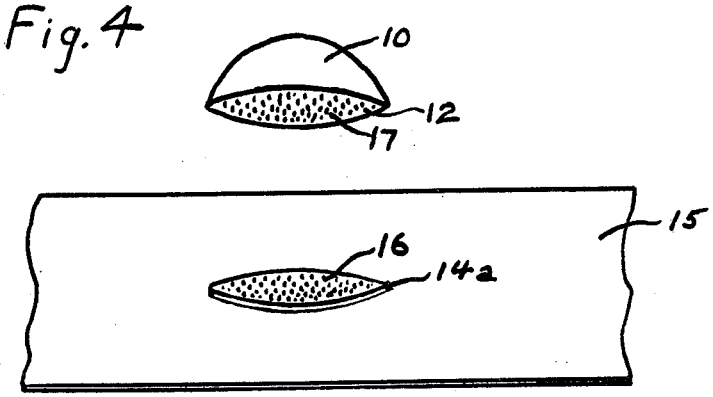
FIG. 4 is a perspective view of another embodiment in which an adhesive pad is used for more firmly attaching the dome in any desired position on a support surface.

An alternative arrangement is illustrated in FIG. 4 wherein the dome 10 is adapted to be temporarily fixed in a desired position on the support surface 15 by means of an adhesive pad **14*a*. In this embodiment the adhesive pad 14*a* has a restickable adhesive on its underside so that it can be temporarily adhered firmly in any desired position on the support surface 15. On its upper side the pad 14*a* has Velcro fastener material, as indicated at 16, for attaching the pad to the Velcro material covered dome base surface, indicated at 17**.

In use the pad **14*a* is adhered in a desired position on the support surface 15 and the dome 10 is attached onto the pad 14*a* by the Velcro fastening. To move the dome to a different position on the surface, and to have it adhered in the new position, the dome 10 is separated from the pad 14*a*, by pulling it therefrom which causes release of the Velcro material covered surfaces from each other. The pad 14*a* is then peeled from the surface 15 and laid down and adhered in the dfferent position desired, after which the dome 10 is pressed down on the pad 14*a* to be mounted thereon by the Velcro material fastening at the mating surfaces. Additionally a series of resilient pads 14 of different thicknesses may be provided with Velcro fastening material on their top and bottom surfaces so that a selected one of the resilient pads 14 can be interposed and fixed between the dome base 12 and the adhesive pad 14*a***.

In any event, as noted above, any resilient pad 14, adhesive pad **14*a* or combination of resilient pad and adhesive pad that are mounted on the dome base 12** should only add a thickness that is relatively minor in relation to the overall height of the dome, because it is the pressure of the hard dome surface into the paining area of a person's back which has proven effective in providing relief.

What is claimed is:

1. A method for relieving backaches and pains of a person, comprising;

a. providing a generally hemispheric dome of hard nonresilient material, said dome having an apex and a flat base with a nonskid surface on said base, having a height from it's base to it's apex of between about 1½ to 2¼ inches (3.81 to 5.71 cms.) and having a diameter at it's base of approximately two times said height;

b. placing said dome on a substantially flat rigid support surface having a surface area at least coinciding with the area of the major portion of said person's back from buttocks to shoulders;

c. said person placing his or her back against said dome in position for said apex of said dome to be at least closely adjacent to an area of said back at which pain is located, but not directly against said person's spinal column; and d. causing said area of said back to press against said dome.

2. The method of claim 1 which includes shifting the relative position of said back and said dome for the dome to be pressed against a different portion of said area of the back.

3. The method of claim 1 in which said nonskid surface on said dome base is provided by a pad of resilient material attached on said base, the thickness of said pad being a minor portion of the overall height of said dome.

4. Apparatus for relieving backaches and pains of a person, comprising;

a. a generally hemispheric dome of hard nonresilient material, said dome having an apex and a flat base with a nonskid surface on said base, the height of said dome between it's base and it's apex being between about 1½ to 2¼ inches (3.81 to 5.71 cms.) and the diameter of said dome at it's base being approximately two times it's height; and b. a substantially rigid flat support surface for said dome, said support surface having an area at least substantially coinciding with the area of the major portion of said person's back from buttocks to shoulders, whereby said dome is adapted to be placed on said support surface for said person to press a portion of his or her back against said dome for relieving pain in the area of said back that is against said dome.

5. The apparatus of claim 4 in which said support surface is a rigid sheet having a dimensional area coinciding with the area of said person's back between the buttocks and shoulders, and having selected positions for said dome marked thereon.

6. The apparatus of claim 4 in which said nonskid surface is provided by a pad of resilient material attached on said base of said dome, the thickness of said pad being a minor portion of the overall height of said dome.

7. The apparatus of claim 6 in which said pad is not more than ¾ of an inch (1.90 cm.) thick.

8. The apparatus of claim 6 in which said pad is a foam rubber-like material.

9. The apparatus of claim 6 in which said pad is adapted to be removed and replaced by another pad of a different thickness.

10. The apparatus of claim 6 in which said nonskid surface is provided by an adhesive pad adapted to be removably adhered in any desired position on said support surface, and in which said dome is adapted to be removably attached to said adhesive pad.

* * * * *

UNITED STATES PATENT OFFICE

CERTIFICATE OF CORRECTION

Patent No. 4,126,129 Dated November 21, 1978

Inventor(s) John R. Rainbow

It is certified that error appears in the above-identified patent and that said Letters Patent are hereby corrected as shown below:

Column 2, lines 56 - 58 should read

Figure 1:
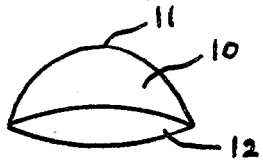
FIG. 1 is a perspective view of a dome in accordance with the invention.

-- Referring to FIG. 1, the key element of the invention is a dome 10 of hard nonresilient material, such as glass or hard acrylic plastic. --.

Signed and Sealed this

*First* Day of *May 1979*

[SEAL]

*Attest:*

RUTH C. MASON
*Attesting Officer*

DONALD W. BANNER
*Commissioner of Patents and Trademarks*